US006322642B1

(12) United States Patent
Bocquet et al.

(10) Patent No.: US 6,322,642 B1
(45) Date of Patent: Nov. 27, 2001

(54) PROCESS AND STEEL FOR THE MANUFACTURE OF A PRESSURE VESSEL WORKING IN THE PRESENCE HYDROGEN SULFIDE

(75) Inventors: Pierre Bocquet, Buxy; Philippe Mabelly; Philippe Bourges, both of Le Creusot, all of (FR)

(73) Assignee: Creusot Loire Industrie, Puteaux (FR)

( * ) Notice: Subject to any disclaimer, the term of this patent is extended or adjusted under 35 U.S.C. 154(b) by 0 days.

(21) Appl. No.: 09/358,662

(22) Filed: Jul. 21, 1999

(30) Foreign Application Priority Data

Jul. 21, 1998 (FR) ..... 98 09271

(51) Int. Cl.[7] ..... C21D 8/00; C21D 9/14; C22C 38/08; C22C 38/44; C22C 38/40

(52) U.S. Cl. ..... 148/336; 148/333; 148/334; 148/335; 148/529; 148/534

(58) Field of Search ..... 148/335, 334, 148/336, 333, 547, 529, 654, 534, 516; 420/119, 108, 109, 110

(56) References Cited

U.S. PATENT DOCUMENTS

| | | | | |
|---|---|---|---|---|
| 2,586,042 | | 2/1952 | Hodge et al. . | |
| 3,110,586 | | 11/1963 | Gulya . | |
| 3,110,635 | | 11/1963 | Gulya . | |
| 6,045,630 | * | 4/2000 | Fujiwara et al. | 148/336 |
| 6,066,212 | * | 5/2000 | Koo et al. | 148/336 |

FOREIGN PATENT DOCUMENTS

| | | |
|---|---|---|
| 987184 | 3/1965 | (GB) . |
| 1020572 | 2/1966 | (GB) . |
| 1034 424 | 6/1966 | (GB) . |
| 553305 | 4/1977 | (GB) . |
| 1 542 503 | 3/1979 | (GB) . |

OTHER PUBLICATIONS

Patent Abstracts of Japan, T. Hiroshi; vol. 95, No. 007; Aug. 31, 1995; (w/copy of Japanese language reference 7–109520, Apr. 25, 1995).

Patent Abstracts of Japan; A Kenichi; vol. 17, No. 589; Oct. 27, 1993; (w/ copy of Japanese language reference 5–171–343, Jul. 9, 1993).

Patent Abstracts of Japan; I. Hiroki; vol. 95, No. 008, Sep. 1995; (w/ copy of Japanese language reference 7–113140, May 2, 1995).

* cited by examiner

*Primary Examiner*—Deborah Yee
(74) *Attorney, Agent, or Firm*—Oblon, Spivak, McClelland, Maier & Neustadt, P.C.

(57) ABSTRACT

Process for manufacturing a pressure vessel intended to work under pressure between −40° C. and 200° C. in the presence of $H_2S$ under conditions defined by the NACE MR 0175-97 standard, in which: components of the vessel are manufactured from a steel of chemical composition: 0.03%≦C≦0.15%; 0%≦Si≦0.5%; 0.4%≦Mn≦2.5%; 0.5%≦Ni≦3%; 0%≦Cr≦1%; 0%≦Mo≦0.5%; 0%≦Al≦0.070%; 0%≦Ti≦0.04%; 0%≦B≦0.004%; 0%≦V≦0.02%; 0%≦Nb≦0.05%; Cu≦1%; S≦0.015%; P≦0.03%; the balance being iron and impurities resulting from the smelting operation; CET=C+(Mn+Mo)/10+(Cr+Cu)/20+Ni/40<0.35; 800/500 cct<10 s; the components being quenched and tempered; the structure is martensitic or martensitic-bainitic with less than 10% ferrite; the temper temperature is <680° C. Optionally, a stress-relieving operation is carried out at a temperature ≧595° C. The components are welded under conditions such that the cooling time tc between 800° C. and 500° C. of the HAZ is >5 seconds and a postweld heat treatment is carried out between 595° C. and 680° C., the steel being such that $R_m$≧550 MPa, $R_e$≧450 MPa, A %≧17%, $K_{CV}$≧40 J at −40° C. and the hardness at any point on the surface of the vessel is ≦248 HV. Vessel obtained and steel.

11 Claims, No Drawings

PROCESS AND STEEL FOR THE MANUFACTURE OF A PRESSURE VESSEL WORKING IN THE PRESENCE HYDROGEN SULFIDE

BACKGROUND OF THE INVENTION

1. Field of the Invention

The present invention relates to a special steel and to the manufacture of pressure vessels. Preferably the pressure vessels are adapted to work under pressure under conditions in which there is a risk of $H_2S$-induced stress cracking.

2. Discussion of the Related Art

In the petrochemical industry, pressure vessels are used for heating gases having high $H_2S$ contents. These vessels, which work under pressure and contain inflammable gases, pose significant safety problems which are solved by applying construction rules codified by various standards or construction codes, particularly the NACE MR 0175-97 standard and the codes of the ASME-code type. $H_2S$, particularly in the presence of moisture, induces a risk of failure by stress corrosion, and the NACE standard defines $H_2S$ partial-pressure conditions for which particular construction rules have to be observed in order to guarantee safety of the plants. These construction rules are also defined by the standard and imposed on manufacturers.

In general, the NACE MR 0175-97 standard stipulates that the materials must give satisfactory results when they are subjected to cracking tests in the presence of hydrogen, defined by the NACE TM 0 177-90 standard, and indicates in a very general manner the materials and the operating conditions likely to give satisfaction. In the case of pressure vessels, it is theoretically possible to use carbon or low-alloy steels, both in the normalized state and in the quench-tempered state, as long as they contain less than 1% nickel and have a hardness of less than or equal to 22 HRC. If the vessels and their components were stress-relieved, the stress-relieving operation must have been carried out above 595° C. In addition, after the components have been joined together by welding, the vessels must be subjected to a postweld heat treatment at a temperature of greater than 620° C. so as to obtain a hardness of less than or equal to 22 HRC at any point.

In general, pressure vessels working under conditions in which there is a risk of $H_2S$-induced stress cracking are manufactured using carbon and manganese steels in the normalized state, the guaranteed tensile strength $R_m$ of which does not exceed 485 MPa. As a result, the plants thus constructed have a large wall thickness and are therefore very heavy. The heavy weight is a problem, especially in the case of plants installed on offshore platforms.

In order to increase the guaranteed mechanical properties, it has been proposed to use carbon and manganese steels in the quench-tempered state. However, these steels do not allow a tensile strength of greater than 500 MPa to be guaranteed, nor a yield stress of greater than 400 MPa. Likewise, these properties can be guaranteed only in the case of thicknesses not exceeding approximately 80 mm.

It is also possible to use low-carbon steels microalloyed with vanadium or niobium and obtained by controlled rolling. These steels allow a guaranteed tensile strength level of approximately 550 MPa and a guaranteed yield stress level of approximately 450 MPa to be achieved. However, on the one hand these steels cannot be used to manufacture hot-formed components, and on the other hand they can only be used with thicknesses less than 40 mm.

Certainly, there are many low-alloy steels used in boilermaking in the quench-tempered state which allow higher design mechanical properties to be obtained, but these steels do not allow the conditions stipulated by the NACE standard to be met. In addition, they require welding precautions that it is not always easy to reliably comply with on work sites, especially when repair operations are being carried out. The use of these steels for the type of application envisaged here would run the risk of creating defects in the welds, and consequently the risk of serious incidents.

More specifically, in order to manufacture safe pressure vessels, suitable welding conditions must be chosen, these being characterized especially by a minimum preheat temperature and a minimum welding energy per unit length. These welding conditions may be combined in the form of a cooling time between 800° C. and 500° C. of the weld bead or of the zone affected by the welding heat (as defined in the NF: A 36-000 standard). To meet the maximum hardness criterion of 22 HRC, the inventors have found that this cooling time must be greater than a critical value which they call "800/500 cct" (which will be defined more fully later) and which depends on the steel used and on the constraints imposed by the construction codes. The welding is more difficult to carry out reliably the higher this value is. The quench-tempered steels used in boilermaking have an 800/500 cct (critical cooling time between 800° C. and 500° C.) of greater than 10 s, which is too long to allow these steels to be used tinder satisfactory conditions for manufacturing $H_2S$-resistant pressure vessels.

SUMMARY OF THE INVENTION

One object of the present invention is to remedy these drawbacks by providing a way to manufacture pressure vessels working in an $H_2S$ medium, which are lighter than the known vessels, while being just as safe.

For this purpose, one subject of the invention is a process for manufacturing a pressure vessel intended and adapted to work under pressure between −40° C. and 200° C. under conditions in which there is a risk of $H_2S$-induced stress cracking as defined by the NACE MR 0175-97 standard, incorporated herein by reference, especially section 1.3 thereof, most especially sections 1.3.1.1 and 1.3.1.2 thereof, in which:

components of the pressure vessel are manufactured from a steel whose chemical composition comprises iron and, by weight and based on total weight:

| | | |
|---|---|---|
| 0.03%≦ | C | ≦0.15% |
| 0%≦ | Si | ≦0.5% |
| 0.4%≦ | Mn | ≦2.5% |
| 0.5%≦ | Ni | ≦3% |
| 0%≦ | Cr | ≦1% |
| 0%≦ | Mo | ≦0.5% |
| 0%≦ | Al | ≦0.07% |
| 0%≦ | Ti | ≦0.04% |

with, preferably Al+Ti≧0.01%

| | | |
|---|---|---|
| 0%≦ | B | ≦0.004% |
| 0%≦ | V | ≦0.02% |
| 0%≦ | Nb | ≦0.05% |

-continued

| | |
|---|---|
| Cu | ≦1% |
| S | ≦0.015% |
| P | ≦0.03% |

and impurities resulting from the smelting operation, the chemical composition preferably being such that CET=C+(Mn+Mo)/10+(Cr+Cu)/20+Ni/40<0.35 and such that the 800/500 cct is less than 10 s, the components being quenched and tempered, after or before forming, so as to obtain a tampered martensitic or martensitic-bainitic structure containing less than 10% ferrite and preferably not containing any ferrite, the temper being carried out at a temperature $T_T$ preferably of less than 680° C.;

after the components have been formed, optionally a stress-relieving operation is carried out a temperature of greater than or equal to 595° C.;

the components of the pressure vessel are welded with a welding energy and preheat conditions such that the 800/500 ct (cooling time between 800° C. and 500° C.) of the heat-affected zone of the welding is greater than or equal to five seconds, and a postweld heat treatment is carried out at a temperature $T_{PW}$ of greater than 595° C. and less than 680° C., preferably of less than 650° C., the steel then having a tensile strength of greater than or equal to 550 MPa, a yield stress of greater than or equal to 450 MPa, an elongation A % of greater than 17% and an impact strength $K_{CV}$ at −40° C. of greater than 40 joules, the hardness at any point of the surface of the vessel being less than 248 HV.

Preferably, the chemical composition of the steel is such that Nb+V≦0.02%; preferably too, it is such that:

| | | |
|---|---|---|
| 0.04%≦ | C | ≦0.09% |
| | Cr | ≦0.6% |
| 0.2%≦ | Mo | 0.5%. |

The invention also relates to a pressure vessel intended to work under pressure between −40° C. and 200° C. under conditions in which there is a risk of $H_2S$-induced stress cracking, as defined by the NACE MR 0175-97 standard, especially sections 1.3.1.1 and 1.3.1.2 thereof. This pressure vessel is made of a steel whose chemical composition comprises iron and, by weight based on total weight:

| | | |
|---|---|---|
| 0.03%≦ | C | ≦0.15% |
| 0%≦ | Si | ≦0.5% |
| 0.4%≦ | Mn | ≦2.5% |
| 0.5%≦ | Ni | ≦3% |
| 0%≦ | Cr | ≦1% |
| 0%≦ | Mo | ≦0.5% |
| 0%≦ | Al | ≦0.07% |
| 0%≦ | Ti | ≦0.04% |

with, preferably Al+Ti≧0.01%

| | | |
|---|---|---|
| 0%≦ | B | ≦0.004% |
| 0%≦ | V | <0.02% |
| 0%≦ | Nb | <0.05% |

-continued

| | |
|---|---|
| Cu | ≦1% |
| S | ≦0.015% |
| P | ≦0.03%, |

and impurities resulting from the smelting operation, the chemical composition being such that CET=C+(Mn+Mo)/10+(Cr+Cu)/20+Ni/40<0.35 and such that the 800/500 cct is less than 10 s. The steel preferably has a tempered martensitic or martensitic-bainitic structure containing less than 10% ferrite, and preferably not containing any ferrite, a tensile strength $R_m$ of greater than or equal to 550 MPa, a yield stress of greater than or equal to 450 MPa. an elongation A % of greater than 17% and an impact strength $K_{Cv}$ at −40° C. of greater than or equal to 40 joules. In addition, the hardness at any point on the surface of the vessel is less than 248 HV.

Preferably, the composition of the steel is such that Nb+V≦0.02%. It is also preferable that:

| | | |
|---|---|---|
| 0.04%≦ | C | ≦0.09% |
| | Cr | ≦0.6% |
| 0.2%≦ | Mo | ≦0.5%. |

The wall thickness of the pressure vessel may vary without limitation and preferably may be between 50 mm and 300 mm.

Finally, the invention relates to a steel for the manufacture of a pressure vessel intended to work under pressure between −40° C. and 200° C. under conditions in which there is a risk Of $H_2S$-induced stress cracking, as defined by the NACE MR 0175-97 standard, especially sections 1.3.1.1 and 1.3.1.2 thereof, the chemical composition comprising iron and, by weight based on total weight:

| | | |
|---|---|---|
| 0.03%≦ | C | ≦0.15% |
| 0%≦ | Si | ≦0.5% |
| 0.4%≦ | Mn | ≦2.5% |
| 0.5%≦ | Ni | ≦3% |
| 0%≦ | Cr | ≦1% |
| 0%≦ | Mo | ≦0.5% |
| 0%≦ | Al | ≦0.07% |
| 0%≦ | Ti | ≦0.04% |

with, preferably Al+Ti≧0.01%

| | | |
|---|---|---|
| 0%≦ | B | ≦0.004% |
| 0%≦ | V | ≦0.02% |
| 0%≦ | Nb | ≦0.05% |
| Cu | ≦1% | |
| S | ≦0.015% | |
| P | ≦0.03%, | |

and impurities resulting from the smelting operation, the chemical composition being such that CET=C+(Mn+Mo)/10+(Cr+Cu)/20+Ni/40<0.35, the steel having an 800/500 cct of less than 10 s.

Preferably, the chemical composition is such that Nb+V≦0.02%. It is also preferable that:

| | | |
|---|---|---|
| 0.04% ≦ | C | ≦0.09% |
| | Cr | ≦0.6% |
| 0.2%≦ | Mo | ≦0.5%. |

The invention will now be described in greater detail and illustrated by examples.

DESCRIPTION OF THE PREFERRED EMBODIMENTS

In order to manufacture a pressure vessel intended to work under pressure between −40° C. and 200° C. under conditions in which there is a risk of $H_2S$-induced stress cracking, as defined by the NACE MR 0175-97 standard, especially sections 1.3 including 1.3.1.1 and 1.3.1.2 thereof, a steel is used whose chemical composition comprises, by weight:

- from 0.03% to 0.15%, and preferably less than 0.09%, of carbon in order to obtain a sufficient tensile strength while still allowing an underbead hardness of less than 248 HV to be obtained after the postweld heat treatment;
- from 0% to 0.5% of silicon in order to deoxidize;
- from 0.4% to 2.5% of manganese in order to obtain a sufficient tensile strength while still allowing the heat-affected zones of the welding to soften and improving the low-temperature impact strength of the bainitic structures, when the metal contains such structures;
- from 0.5% to 3% of nickel in order to improve the hardenability, this being necessary in order to obtain the desired mechanical properties for large thicknesses, while still allowing the heat-affected zones of the welding to soften and improving the low-temperature impact strength of the bainitic structures, when the metal contains such structures;
- less than 1% and preferably less than 0.6% of chromium; this element is favorable for obtaining good mechanical properties after tempering, but makes it difficult to obtain an underbead hardness of less than 248 HV;
- less than 0.5% of molybdenum, for the same reasons as for chromium, but preferably more than 0.2% in order to make it easier to obtain the mechanical properties after a substantial temper;
- optionally, up to 0.02% of vanadium and up to 0.05% of niobium; preferably, the sum of the vanadium and niobium contents must not exceed 0.02%; these elements allow the mechanical properties to be improved but make it difficult to obtain an underbead hardness after the postweld heat treatment of less than 248 HV;
- less than 1% of copper; this element is generally an impurity brought in by the raw materials; it may also be added in order to increase the tensile mechanical properties by a structural hardening effect in the presence of nickel; however, in too large a quantity it makes hot forming difficult;
- from 0% to 0.07% of aluminum in order to deoxidize and fix the nitrogen still present as a residue from the smelting operation;
- optionally, up to 0.04% of titanium in order to fix the nitrogen;
- preferably, the sum of the aluminum and titanium contents must be greater than 0.01%, especially in order to control the grain size;
- optionally, tip to 0.004% of boron in order to increase the hardenability.

The balance comprises, consists essentially of or consists of iron and impurities resulting from the smelting operation. These impurities are, in particular, sulfur and phosphorus, the contents of which preferably remain, respectively, less than 0.015% in order to improve the $H_2S$ resistance and less than 0.03% in order to limit the sensitivity of the steel to reversible temper brittleness.

In order to obtain good weldability, the chemical composition is such that:

$$CET=C+(Mn+Mo)/10+(Cr+Cu)/20+Ni/40\leqq 0.35$$

(in this expression, C, Mn, etc. represent the contents in percent of the corresponding elements).

In addition, the steel is chosen so that the 800/500 cct (critical cooling time) is less than 10 s.

The critical cooling time, 800/500 cct, is measured from a series of BOP (Bead On Plate) tests which consist in measuring the underbead hardness on a 20 mm thick specimen on which a weld has been produced using the submerged-arc process and then a postweld heat treatment, consisting of a temperature hold at 620° C. for four hours, is carried out, this temperature hold being preceded by heating the specimen and followed by cooling it, both the heating and the cooling taking place at a rate of 50° C./hour. In order to determine the 800/500 cct, the welding energy is varied between 1 kJ/mm and 3 kJ/mm, which makes the cooling time 800/500 ct vary between 4 s and 20 s, and then the curve of the underbead hardness as a function of the cooling time 800/500 ct is plotted and the cooling time 800/500 ct for which the underbead hardness is 248 HV is determined; this time is the critical cooling time 800/500 cct. The underbead hardness is measured as claimed in French Standard NF A 81-460.

It should be noted that the NACE standard refers to an underbead hardness of less than 22 HRC. However, it is often difficult to measure the HRC hardness and, because of its principle, it gives a local average of the hardness. It is preferable, and easier, to carry out a measurement of the Vickers hardness and, because of the relationship between the Vickers hardness and the Rockwell C hardness by guaranteeing a Vickers hardness of less than or equal to 248 HV, a Rockwell C hardness of less than 22 HRC is guaranteed.

Pressure vessel components are manufactured from this steel, cast in the form of slabs or ingots. These components may be shells, obtained either by forging or by forming plate into shells; they may also be heads in the form of spherical caps obtained by forging or by pressing circular plate. These components, the walls of which may have a thickness of between 50 mm and 300 mm, are formed hot or cold, subjected to a quenching and tempering heat treatment and then joined together by welding. Finally, the vessel thus obtained is subjected to a "postweld" heat treatment. The entire heat treatment is adjusted so that the structure of the steel is a tempered martensitic or martensitic-bainitic structure containing less than 10% ferrite, and preferably not containing any ferrite, and so that:

- the tensile strength $R_m$ of the steel is greater than or equal to 550 MPa
- the yield stress $R_e$ of the steel is greater than or equal to 450 MPa;
- the elongation A % of the steel is greater than or equal to 17%;
- the impact strength $K_{CV}$ of the steel at −40° C. is greater than or equal to 40 joules (an average of three tests); and the hardness at any point on the vessel is less than 248 HV.

Those of ordinary skill in the are capable of making such components and vessels.

The quench is carried out, after reheating the steel to above the $AC_3$ point, by cooling in water, in oil, in blown air or in still air, depending on the thickness of the component.

The heat treatment includes at least one temper carried out after the quench and at a temperature generally greater than 550° C., and preferably less than 680° C. When the temper is carried out at a temperature greater than 680° C., it corresponds to an "intercritical" treatment. In this case, it may be necessary to control the cooling, like after a quench.

The "postweld" treatment is an annealing treatment carried out at a temperature of greater than or equal to 595° C. and preferably greater than 620° C., but less than 680° C.

Depending on the nature of the components and the method of manufacture, the quenching and tempering treatment may be carried out before or after forming, and the temper may be intended simply to make forming, easier or, on the contrary, to give the steel its final properties. In the first case, the postweld treatment gives the steel its final properties and the prior temper temperature is less than the postweld treatment temperature. In the second case, the postweld treatment essentially serves to stress-relieve the vessel and to soften the heat-affected zones of the welding; the postweld treatment must therefore be carried out at a temperature below the temper temperature.

In order to obtain satisfactory welds, for example with the aid of the SAW process (Submerged Arc Welding: the arc submerged beneath the powdered flux) using filler products having a low hydrogen content (<5 ml/100 g), the material is preheated to a temperature of less than 125° C. and a welding energy is chosen to be between 1 kJ/mm and 5 kJ/mm so that, in the phase of cooling the weld bead, the cooling time between 800° C. and 500° C. (800/500 ct) is greater than or equal to 5 s. These parameters may be determined depending on the thickness of the wall to be welded and on the particular welding conditions, for example using the method defined in the NF A 36.000 standard.

The postweld treatment temperature $T_{PW}$ allowing an underbead hardness of less than 248 HV (or 22 HRC) to be obtained depends partly on the parameter 800/500 ct. It follows that it is preferable to determine the welding conditions and the postweld treatment conditions simultaneously, which can be done by a few BOP tests on specimens.

By way of example, steels having the following chemical compositions (in percent by weight) may be used:

| | C | Si | Mn | Ni | Cr | Mo | Cu | V | CET |
|---|---|---|---|---|---|---|---|---|---|
| A | 0.08 | 0.24 | 0.89 | 1.8 | 0.25 | 0.4 | 0.21 | 0.01 | 0.28 |
| B | 0.07 | 0.23 | 1.57 | 1.37 | 0.21 | 0.21 | 0.23 | 0.01 | 0.30 |
| C | 0.06 | 0.23 | 1.72 | 1.77 | 0.11 | 0.21 | 0.24 | 0.01 | 0.31 |
| D | 0.06 | 0.23 | 1.32 | 1.6 | 0.26 | 0.25 | 0.2 | 0.01 | 0.28 |
| E | 0.06 | 0.16 | 0.9 | 1.87 | 0.25 | 0.4 | 0.21 | 0.01 | 0.25 |

These steels may be quenched and then tempered at 665° C. in order to obtain a tempered martensitic-bainitic structure, free of ferrite and having a hardness of between 195 and 210 HV. These steels have a critical cooling time, 800/500 cct of less than 10 s, as shown by the following results, obtained using the method described above:

| 800/500 ct (s) | HV underbead hardness A | B | C | D | E |
|---|---|---|---|---|---|
| 5 | 255 | 246 | 241 | 250 | 248 |
| 11 | 243 | 234 | 229 | 228 | 243 |
| 14 | 241 | 239 | 236 | 240 | 243 |
| 24.7 | 236 | 229 | 226 | 231 | 239 |

These results lead to critical cooling times, 800/500 cct, of 8 s for A, less than 4 s for B and C, 6 s for D and 5 s for E. The hardnesses obtained on the base metal correspond to a tensile strength of between 580 and 640 MPa.

Also by way of example, a steel having the following composition may be used:

| C | Si | Mn | Ni | Cr | Mo | Cu |
|---|---|---|---|---|---|---|
| 0.04 | 0.14 | 1.20 | 0.85 | 0.18 | 0.29 | 0.72 |
| Al | S | P | Sn | As | Sb | CET |
| 0.02 | 0.002 | 0.006 | 0.015 | 0.014 | 0.001 | 0.26 |

This steel has a critical cooling time 800/500 cct of less than 4 s.

Using, this steel, a pressure vessel was manufactured from 95 mm thick plate quenched and tempered at 500° C., having a ferrite-free tempered martensitic-bainitic structure, the mechanical properties of which, measured at quarter-thickness in the long transverse direction were:

| | |
|---|---|
| - yield stress | $R_{p0.2}$ = 495 MPa |
| - strength | $R_m$ = 555 MPa |
| - elongation | A% = 29% |
| - reduction in section | Z% = 79% |
| - Charpy V impact strength (an average of three tests): | $K_{CV}$ at −20° C.>286 J<br>$K_{CV}$ at −40° C.>263 J. |

The plates were submerged-arc welded using a wire of the E 9018 G type with a double-V groove, in the 3 G position, using an average welding energy of 2.6 J/mm, a preheat temperature of 75° C. and a temperature between passes of 100° C. After welding, the vessel was subjected to a stress-relieving heat treatment consisting in heating it at a rate of 50° C./h up to 610° C., then holding it at this temperature for six hours and then cooling it at the maximum rate of 50° C./h down to room temperature.

The mechanical properties, obtained on the welds, were measured and the following results were obtained:

tensile testing across the weld at room temperature: $R_m$=584 MPa with failure in the base metal;

tensile testing within the deposited weld metal, along the bead, at room temperature: $R_{p0.2}$=591 MPa; $R_m$=667 MPa; A=24%;

Charpy V impact strengths at −40° C.: on the deposited weld metal=66 J in the HAZ: 257 J;

HV10 hardness measured across the weld at quarter-thickness: base metal=181 to 192 HV HAZ=216 to 221 HV deposited weld metal=228 to 242 HV Moreover, NACE tests as claimed in the NACE TM 0177 standard were carried out on this metal, which gave satisfactory results.

Using a steel as claimed in the prior art, the pressure vessel would have had to be constructed from 106 mm thick plate. Thus a 12% weight saving was obtained.

By way of counterexample, a quench-tempered steel is known which allows plate to be obtained with roughly the same tensile properties as above and which has the following chemical composition:

| C | Si | Mn | $N_1$ | Cr | Mo | Cu |
|---|---|---|---|---|---|---|
| 0.01 | 0.245 | 1.32 | 0.509 | 0.147 | 0.212 | 0.17 |
| Al | V | S | P | Sn | CET | |
| 0.018 | 0.047 | 0.0007 | 0.0088 | 0.009 | 0.26 | |

However, this steel has the drawback of having a very high critical cooling time 800/500 cct since, for a cooling, time of 10.4 s, the underbead hardness is 262 HV after a postweld treatment of 4 h at 620° C., thereby preventing it from meeting the conditions stipulated by the NACE standard.

NACE standard MR 0175-97, sections 1.3.1.1 and 1.3.1.2 are explained below, where SSC is sulfide stress cracking:

1.3.1.1 Sour Gas: Materials shall be selected to be resistant to SSC or the environment should be controlled if the gas being handled is at a total pressure of 0.4 Mpa (65 psia) or greater and if the partial pressure of $H_2S$ in the gas is greater than 0.0003 Mpa (0.05 psia). Systems operating below 0.4 Mpa (65 psia) total pressure or below 0.0003 Mpa (0.05 psia) $H_2S$ partial pressure are outside the scope of this standard. Partial pressure is determined by multiplying the mole fraction (mol %+100) of $H_2S$ in the gas by the total system pressure.

1.3.1.2 Sour Oil and Multiphases: Sour crude oil systems that have operated satisfactorily using standard equipment are outside the scope of this standard when the fluids being handled are either crude oil or two- or three-phase crude, water, and gas when:

(1) the maximum gas:oil ratio is 5,000 SCF:bbl (barrel of oil);

(2) the gas phase contains a maximum of 15% $H_2S$;

(3)the partial pressure of $H_2S$ in the gas phases is a maximum of 0.07 Mpa (10 psia);

(4) the surface operating pressure is a maximum of 1.8 Mpa (265 psia); and (5) when pressure exceeds 1.8 Mpa (265 psia), refer back to Paragraph 1.3.1.1.

The satisfactory service of the standard equipment in these low-pressure systems is believed to be a result of the inhibitive effect of the oil and the low stresses encountered under the low-pressure conditions.

French patent application 98 09271 is incorporated herein by reference.

What is claimed is:

1. A process for manufacturing a pressure vessel intended to work under pressure between −40° C. and 200° C. under conditions in which there is a risk of $H_2S$-induced stress cracking as defined by the NACE MR 0175-97 standard, comprising:

providing a steel whose chemical composition comprises, by weight:

| | | |
|---|---|---|
| 0.03% ≦ | C | ≦0.15% |
| 0% ≦ | Si | ≦0.5% |
| 0.4% ≦ | Mn | ≦2.5% |
| 0.5% ≦ | Ni | ≦3% |
| 0% ≦ | Cr | ≦1% |
| 0% ≦ | Mo | ≦0.5% |
| 0% ≦ | Al | ≦0.07% |
| 0% ≦ | Ti | ≦0.04% |
| 0% ≦ | B | ≦0.004% |
| 0% ≦ | V | ≦0.02% |
| 0% ≦ | Nb | ≦0.05% |
| | Cu | ≦1% |
| | S | ≦0.015% |
| | P | ≦0.03% |

and impurities resulting from smelting, the chemical composition being such that CET=C+(Mn+Mo)/10+(Cr+Cu)/20+Ni/40<0.35 and such that the 800/500 cct is <10 s, forming components of said pressure vessel from said steel, quenching and tempering said components before or after said forming to obtain a martensitic or martensitic-bainitic structure containing less than 10% ferrite, optionally stress-relieving said components at a temperature≧595 ° C., welding said components with a welding energy and preheat conditions such that the 800/500 ct of the heat affected zone≧5 s, and heat treating said components after said welding at a temperature>595° C.<680° C., such that the steel has a tensile strength of greater than or equal to 550 MPa, a yield stress of greater than or equal to 450 MPa, an elongation A % of greater than 17% and an impact strength $K_{CV}$ at −40° C. of greater than 40 joules, the hardness at any point of the surface of the vessel being less than 248 HV.

2. The process as claimed in claim 1, wherein said chemical composition of said steel is such that Nb+V≦0.02%.

3. The process as claimed in claim 1, wherein said chemical composition of said steel is such that:

| | | |
|---|---|---|
| 0.04%≦ | C | ≦0.09% |
| | Cr | ≦0.6% |
| 0.2%≦ | Mo | ≦0.5%. |

4. The process as claimed in claim 1, wherein said chemical composition of said steel is such that Al+Ti≧0.01%.

5. The process as claimed in claim 1, wherein the tempering temperature is less than 680° C.

6. A pressure vessel adapted to work under pressure between −40° C. and 200° C. under conditions in which there is a risk of $H_2S$-induced stress cracking as defined by the NACE MR 0175-97 standard, wherein:

said vessel is made of a steel whose chemical composition comprises iron and, by weight based on total weight:

| | | |
|---|---|---|
| 0.03% ≦ | C | ≦0.15% |
| 0% ≦ | Si | ≦0.5% |
| 0.4% ≦ | Mn | ≦2.5% |
| 0.5% ≦ | Ni | ≦3% |
| 0% ≦ | Cr | ≦1% |

-continued

| | | |
|---|---|---|
| 0% ≦ | Mo | ≦0.5% |
| 0% ≦ | Al | ≦0.07% |
| 0% ≦ | Ti | ≦0.04% |
| 0% ≦ | B | ≦0.004% |
| 0% ≦ | V | ≦0.02% |
| 0% ≦ | Nb | ≦0.05% |
| | Cu | ≦1% |
| | S | ≦0.015% |
| | P | ≦0.03% |

and impurities resulting from smelting, the chemical composition being such that CET=C+(Mn+Mo)/10+(Cr+Cu)/20+Ni/40<0.35 and such that the 800/500 cct<10 s; wherein said steel has a martensitic or martensitic-bainitic structure containing less than 10% ferrite;

the tensile strength $R_m$ of said steel is greater than or equal to 550 MPa;

the yield stress $R_e$ of said steel is greater than or equal to 450 MPa;

the elongation A % of said steel is greater than or equal to 17%;

the impact strength $K_{CV}$ of said steel at −40° C. is greater than or equal to 40 joules; and the hardness at any point on the surface of said vessel is less than 248 HV.

7. The pressure vessel as claimed in claim 6, wherein said chemical composition of said steel is such that Nb+V≦0.02%.

8. The pressure vessel as claimed in claim 6, wherein said chemical composition of said steel is such that:

| | | |
|---|---|---|
| 0.04%≦ | C | ≦0.09% |
| | Cr | ≦0.6% |
| 0.2%≦ | Mo | ≦0.5%. |

9. The pressure vessel as claimed in claim 6, wherein said chemical composition of said steel is such that Al+Ti≧0.01%.

10. The pressure vessel as claimed in claim 6, wherein a wall thickness is between 50 mm and 300 mm.

11. The process as claimed in claim 1, wherein said heat treating, after said welding is at a temperature>620° C.<680° C.

* * * * *